US010538006B2

(12) United States Patent
Bridges et al.

(10) Patent No.: US 10,538,006 B2
(45) Date of Patent: Jan. 21, 2020

(54) SHAVING RAZORS AND CARTRIDGES

(71) Applicant: The Gillette Company LLC, Boston, MA (US)

(72) Inventors: Kelly Daniel Bridges, Quincy, MA (US); Alejandro Carlos Lee, Cambridge, MA (US); Carl Phillip Haney, Newton, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 15/271,377

(22) Filed: Sep. 21, 2016

(65) Prior Publication Data

US 2017/0008183 A1 Jan. 12, 2017

Related U.S. Application Data

(60) Continuation of application No. 14/800,778, filed on Jul. 16, 2015, now abandoned, which is a continuation of application No. 13/482,391, filed on May 29, 2012, now abandoned, which is a division of application No. 12/563,219, filed on Sep. 21, 2009, now abandoned.

(51) Int. Cl.

| | |
|---|---|
| ***B26B 21/14*** | (2006.01) |
| ***B26B 21/22*** | (2006.01) |
| ***B26B 21/40*** | (2006.01) |
| ***B26B 21/52*** | (2006.01) |

(52) U.S. Cl.

CPC ..... *B26B 21/521* (2013.01); *B26B 21/14* (2013.01); *B26B 21/222* (2013.01); *B26B 21/225* (2013.01); *B26B 21/4012* (2013.01)

(58) Field of Classification Search

CPC .... B26D 21/14; B26D 21/222; B26D 21/225; B26D 21/521; B26B 21/4012

USPC ..... 30/526, 527, 530, 532, 533, 50, 57

See application file for complete search history.

(56) References Cited

U.S. PATENT DOCUMENTS

| | | | |
|---|---|---|---|
| 1,014,431 | A | 1/1912 | Adler |
| 2,155,749 | A | 4/1939 | Young et al. |
| 2,156,559 | A | 5/1939 | Young et al. |
| 4,258,471 | A | 3/1981 | Jacobson |
| 4,392,303 | A | 7/1983 | Ciaffone |
| 4,791,724 | A | 12/1988 | Dumas |
| 4,797,998 | A | 1/1989 | Motta |
| 4,905,372 | A | 3/1990 | Willis |
| 4,970,784 | A | 11/1990 | Althaus et al. |
| 5,347,717 | A | 9/1994 | Ts'ai |
| 5,535,518 | A | 7/1996 | Althaus |
| 6,161,288 | A | 12/2000 | Andrews |
| 6,612,040 | B2 | 9/2003 | Gilder |
| 6,615,498 | B1 | 9/2003 | King et al. |
| 6,880,253 | B1 | 4/2005 | Gyllerstrom |

(Continued)

FOREIGN PATENT DOCUMENTS

DE 20 2007 002 013 U1 5/2007

*Primary Examiner* — Clark F Dexter

(74) *Attorney, Agent, or Firm* — John M. Lipchitz

(57) ABSTRACT

A shaving razor with a handle and a housing, the housing dimensioned to receive at least one blade. The housing has a pair of spaced apart opposing parallel walls each defining a fully enclosed opening that extends completely through the respective walls. The handle includes a pair of semi-circular pin members that are disposed in the openings to mount the housing to the handle while allowing rinse water to travel through the openings to access the at least one blade.

4 Claims, 8 Drawing Sheets

(56) References Cited

U.S. PATENT DOCUMENTS

| | | | |
|---|---|---|---|
| 7,086,160 | B2 | 8/2006 | Coffin et al. |
| 2001/0003869 | A1 | 6/2001 | Rocha |
| 2005/0039338 | A1 | 2/2005 | King et al. |
| 2009/0119924 | A1 | 5/2009 | Bozikis |
| 2010/0058595 | A1 | 3/2010 | Walker et al. |

SHAVING RAZORS AND CARTRIDGES

CROSS REFERENCE TO RELATED APPLICATIONS

This application is a continuation application of U.S. application Ser. No. 14/800,778, filed Jul. 16, 2015, now abandoned, which is a continuation application of U.S. application Ser. No. 13/482,391, filed May 29, 2012, now abandoned, which is a divisional application of U.S. application Ser. No. 12/563,219, filed on Sep. 21, 2009, now abandoned.

FIELD OF THE INVENTION

The present invention relates to shaving razors and cartridges and more particularly to shaving cartridges that provide for simple and secure engagement and disengagement to a handle.

BACKGROUND OF THE INVENTION

In recent years shaving razors with numerous blades have been proposed in the literature and commercialized, e.g., U.S. Pat. Pub. 2005/0039337 A1 published on Feb. 24, 2005, which generally describes a type of design that has been commercialized globally as the five bladed Fusion™ razor by The Gillette Company.

In emerging markets, such as China and India, the shaving razor of choice is a standard double edge style razor, e.g., in U.S. Pat. No. 3,274,683 issued Sep. 27, 1966, generally describes a design used in emerging markets. The standard double edge style razor may be economical, but the user tends to experience nicks, cuts and irritation. A majority of emerging market consumers do not have the means to purchase the shaving razors that are widely popular in the United States. Some commercially available shaving razors have pivot mechanisms that include a handle with a pin that fits into a pocket located on a cartridge. These pivot mechanisms do not provide for optimal rinsing and often obstruct water from reaching the blades.

Shaving consumers in emerging markets shave infrequently, sometimes only once or twice a week. There is also little or no availability of running water to rinse or clean a shaving razor and the availability of skin cleansers and pre-shaving and post-shaving shaving aids are limited. Pre-shaving aids may include shaving oils, gels and lotions and post-shaving aids may include after shave gels, lotions and moisturizers. A cup or bowl is typically filled with water and is used to rinse the shaving razor because running water is scarce. It is much more difficult to rinse out a shaving razor in the cup or bowl compared to running water. The shaving razors disclosed in the above mentioned patent application are quite sophisticated having have been designed for Western shaving habits, practices and environments, and thus do not deliver an ideal shaving experience for consumers in emerging markets. The shaving consumers in emerging countries have a much different shaving environment, as well as different shaving habits and practices, than shaving consumers in more developed countries, such as the United States. The shaving consumers in emerging countries want the benefits of various shaving technologies that deliver a closer and more comfortable shave, but they are not willing to sacrifice cost or rinsability of the shaving cartridge.

SUMMARY OF THE INVENTION

In one aspect, the invention features, in general, a shaving razor with a housing dimensioned to receive at least one blade. The housing has a pair of spaced apart opposing parallel walls each defining a fully enclosed opening that extends completely through the respective walls.

In another aspect, the invention features, in general, a handle having a body and a neck extending from the body having an inner surface and an outer surface. The neck has a pair of flexible opposing arms that taper outwardly to define a tapered slot and a pin member extending outwardly from each of the respective arms. The pin members are movable from a first position to a second position. The pin members are closer together in the second position than the first position.

In another aspect, the invention features, in general, a shaving razor with a housing having a first wall defining a first fully enclosed opening extending therethrough and a second wall defining a second fully enclosed opening extending therethrough. A handle is engaged to the housing in a first position and disengaged from the housing in a second position. The handle has a first arm with a pin member and a support member that each extend outwardly from the first arm, and a second arm with a pin member and a support member that each extend outwardly from the second arm. In the first position, the pin member of the first arm is positioned within the first opening and the pin member of the second arm is positioned within the second opening to define a rinse gap between the blade and the pin members.

DETAILED DESCRIPTION OF THE INVENTION

The consumer needs for emerging markets require economical and intuitive shaving razors that include modern advantages, such as replaceable shaving cartridges that follow the contours of the face during shaving and do not unintentionally disengage from the handle. When the shaving cartridge is to be replaced, the shaving cartridge should be able to be removed from the handle in a simple and intuitive manner.

Figure 1:
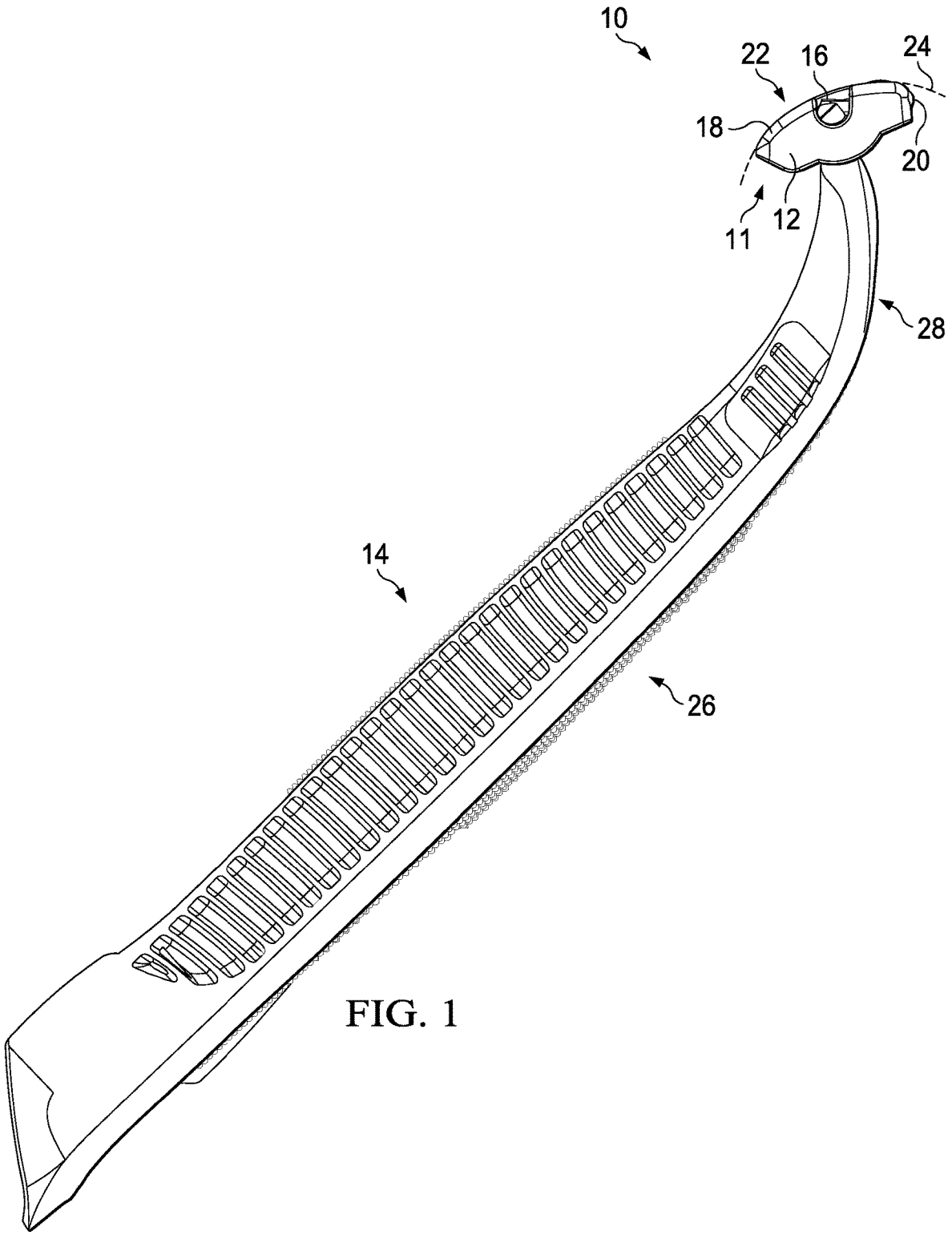
FIG. 1 is a right side view of a shaving razor.

Referring to FIG. 1, one possible embodiment of the present invention is shown illustrating a shaving razor 10 having a shaving cartridge 11 mounted to a shaving razor handle 14 having a body 26 and a neck 28. The body 26 of the handle 14 may provide an area for the user to comfortably grip the shaving razor 10. The neck 28 may have a generally "V" shape geometry that extends from the body 26. As will be explained in greater detail below, the shaving cartridge 11 may be pivotably (i.e., rotation of the cartridge 11 about an axis relative to the shaving razor handle 14) and/or detachably engaged to the shaving razor handle 14. The shaving cartridge 11 may include a housing 12 dimensioned to receive at least one blade 16. The housing 12 may have a guard 18 in front of the blade 16 and a cap 20 behind the blade 16. The housing 12 may have a top surface 22 that extends from the guard 18 to the cap 20. In certain embodiments, the top surface 22 may define an arc 24 with a radius of about 2 mm, 3 mm, or 4 mm to about 6 mm, 8 mm, or 10 mm. The shaving razor 10 may not have a return mechanism, such as spring plunger that biases the housing 12 in a predetermined pivot position relative to the shaving razor handle 14. The lack of a return mechanism allows arcuate top surface 22 to facilitate proper positioning of the housing 12 against the surface of the skin during a shaving stroke. The housing 12 may rotate freely relative to the shaving razor handle 14 (e.g., with little or no force except for friction) as the top surface 22 of the housing 12 glides across the surface of the skin during a shaving stroke to give the user more control of the shaving cartridge 11. Return mechanisms have a tendency to fatigue and/or break with repeated usage, which negatively influences shaving performance (e.g., closeness and comfort). The lack of a return mechanism may also decrease complexity and costs of the shaving razor 10 and improve rinsability by removing obstructions near the blade 16. Return mechanisms may also obstruct the passage of water to the blades, especially if the cartridge is rinsed in a cup or bowl of water instead of flowing water.

Figure 2:
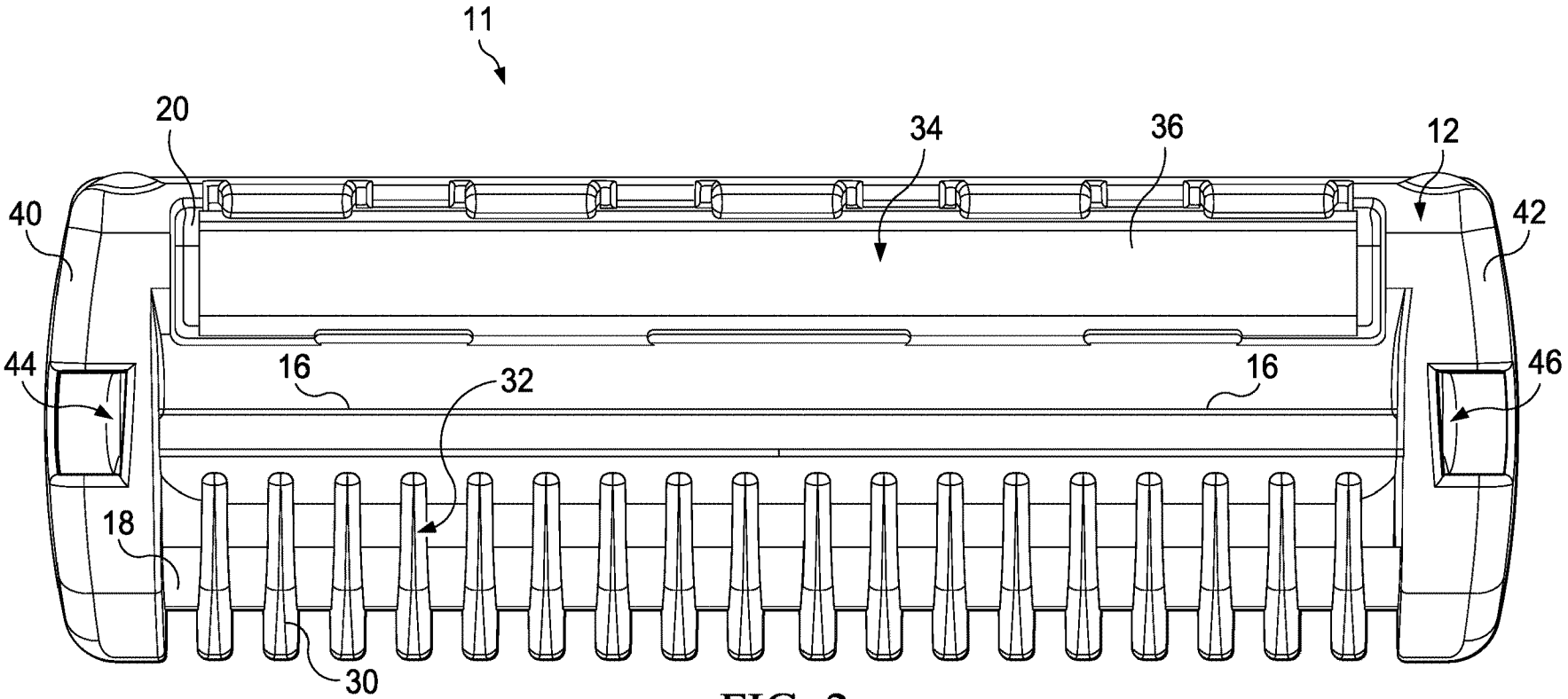
FIG. 2 is a top view of a shaving cartridge which may be incorporated into the shaving razor of FIG. 1.

Referring to FIG. 2, a top view of the shaving cartridge 11 is shown. The housing 12 of the shaving cartridge 11 may be injection molded from a semi-rigid polymeric material. In certain embodiments, the housing 12 may be molded from Noryl™ (a blend of polyphenylene oxide (PPO) and polystyrene developed by General Electric Plastics, now SABIC Innovative Plastics). The housing 12 may be molded from other semi-rigid polymers having a Shore A hardness of approximately 60 to 140, including, but not limited to acetal, polypropylene, high impact polystyrene, or any combinations thereof. Although only one blade 16 is shown, the housing 12 may have two or more blades 16. The blades 16 may be mounted to a the housing and secured by staking, ultrasonic welding, insert molding, wire wrapping, or any other assembly process known to those skilled in the art.

The guard 18 may have a plurality of spaced apart fingers 30 that extend transverse to the blade 16. In certain embodiments, the fingers 30 may have a top surface 32 that defines the arc 24 of the top surface 22 (see FIG. 1) of the housing 12. The cap 20 may also have a top surface 34 that defines the arc 24 of the top surface 22 of the housing 12. In certain embodiments, the cap 20 may have an elongated strip 36 containing a shaving aid to provide lubrication to the surface of the skin during shaving. The housing 12 may have a pair of spaced apart parallel walls 40 and 42 that are transverse to the blade 16. The walls 40 and 42 may each define a fully enclosed opening 44 and 46 that extend completely through the respective walls 40 and 42. The enclosed openings 44 and 46 may facilitate proper engagement of the housing 12 to the shaving razor handle 14 (not shown). Although the walls 40 and 42 are shown as side walls located at opposite terminating ends of the housing 12, the walls 40 and 42 may be any wall of the housing 12, such as an interior wall. The walls 40 and 42 may be positioned at opposite terminating ends of the housing 12 to provide for a more open space between the walls 40 and 42 for enhanced rinsing of the blade 16. For example, water may access the blade 16 from not only the top and/or bottom of the housing 12, but from the side of the housing 12 (i.e., through the openings 44 and 46 in the walls 40 and 42).

Figure 3:
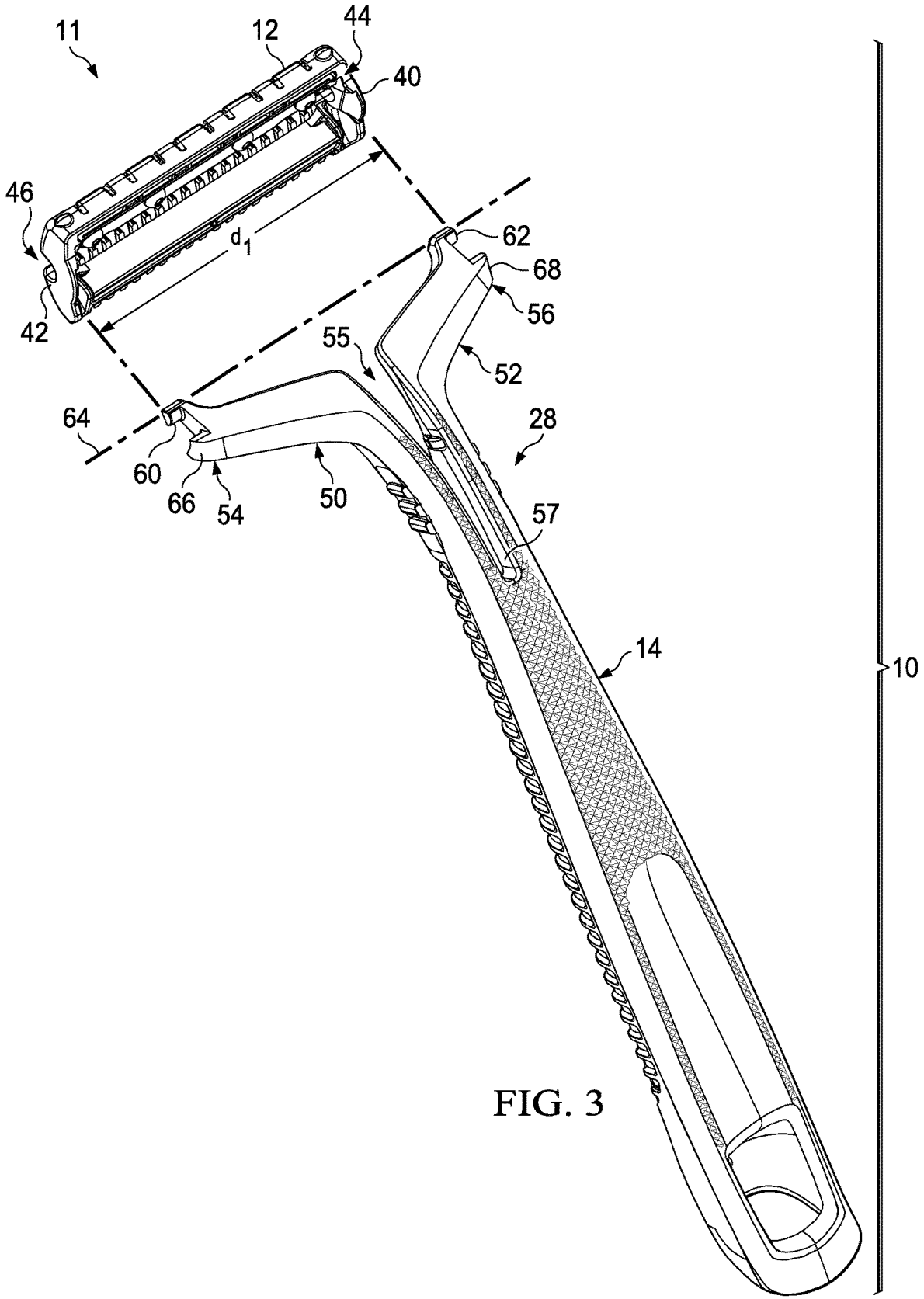
FIG. 3 is a top perspective assembly view of the shaving razor of FIG. 1.

Referring to FIG. 3, an assembly view of the shaving razor 10 is shown with the shaving cartridge 11 detached from the shaving razor handle 14. The walls 40 and 42 of the housing 12 may be spaced apart by a distance $d_1$ to receive the shaving razor handle 14 in releasable engagement, as will be discussed in greater detail below. In certain embodiments, the distance $d_1$ may be about 10 mm, 20 mm, or 30 mm to about 35 mm, 40 mm, or 45 mm. The neck 28 may have a pair of opposing arms 50 and 52 that taper outwardly. The pair of opposing arms 50 and 52 may define a tapered slot 55 that extends into the neck 28 of the shaving razor handle 14, such that the arms 50 and 52 taper closer together toward a base 57 of the tapered slot 55 where the arms 50 and 52 meet. Each arm may have an end portion 54 and 56 with a pin member 60 and 62 that extends outwardly from each of the respective end portions 54 and 56. As will be explained in greater detail below, the tapered slot 55 may allow for a small change in distance between the arms 50 and 52 at the neck 28 to result in a much larger change in distance between the pin members 60 and 62.

A user may engage and disengage the shaving cartridge 11 from the shaving razor handle 14 by squeezing the arms 50 and 52 (e.g., the neck 28) together and pulling the shaving cartridge 11 and the shaving razor handle 14 in opposite directions. The tapered slot 55 may provide the arms 50 and 52 with sufficient flexibility and strength so the shaving razor handle 14 may be repeatedly engaged and disengaged with the shaving cartridge 11 without the arms 50 and 52 fatiguing or breaking. In certain embodiments, an axis of rotation 64 may extend through the center of the pin members 60 and 62. The openings 44 and 46 of the housing 12 may be dimensioned to receive the respective pin members 60 and 62 to facilitate movement (i.e., rotation) of the shaving cartridge 11 about the axis of rotation 64.

A pair of support members 66 and 68 may extend outwardly from the respective end portions 54 and 56. The pair of support members 66 and 68 may facilitate movement of the shaving cartridge 11 about the axis of rotation 64 and may prevent unintentional disengagement of the shaving cartridge 11 from the shaving razor handle 14. The pin members 60 and 62 may be parallel to and spaced apart from the respective support member 66 and 68 to facilitate the engagement with the respective walls 42 and 40. In certain embodiments, the support members 66 and 68 and the pin members 60 and 62 may be perpendicular to the respective walls 42 and 40. The support members 66 and 68 may act as load-bearing structures, such that forces can be transmitted to end portions 54 and 56, as well as, arms 50 and 52, thus relieving stress on the smaller pin members 60 and 62 to prevent breakage or failure of the pin members 60 and 62.

Figure 4:
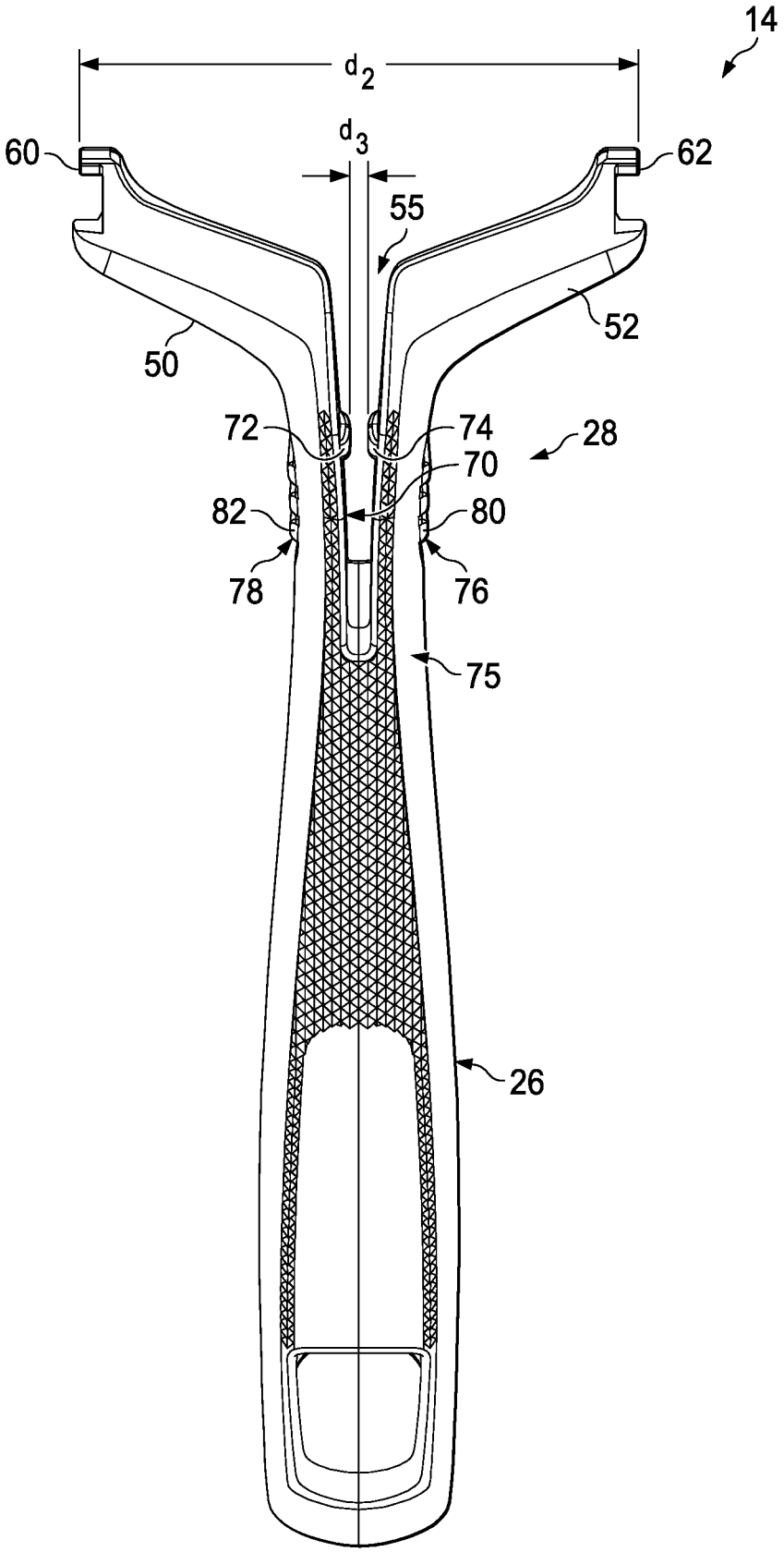
FIG. 4 is a top view of a handle which may be incorporated into the shaving razor of FIG. 1.

The arms 50 and 52 may have a first position to provide for proper engagement of the shaving cartridge 11 to the shaving razor handle 14 and a second position to provide for proper disengagement of the shaving cartridge from the shaving razor handle 14. In the first position, the pin members 60 and 62 may be disposed within the respective openings 46 and 44. With additional reference to FIG. 4, the pin members 60 and 62 may be spaced apart by a distance "$d_2$". In the first position, the distance "$d_2$" may be greater than the distance "$d_1$" (FIG. 3) by the length of the pin members 60 and 62 to provide proper engagement of the pin members 60 and 62 within the respective openings 46 and 44. For example, if $d_1$ is 40 mm and the length of each of the pin members 60 and 62 is 2 mm, then $d_2$ may be 44 mm in the first position. The engagement of the shaving razor handle 14 to the shaving cartridge 11 is enhanced by having the openings 44 and 46 extend completely through the respective walls 40 and 42. The openings 44 and 46 allow the length of the pin members to be increased for more robust engagement under both dimensional tolerance variations and in use. For example, dimensional variations may cause a pin to prematurely bottom out in a blind hole or a pocket, thus the full length of the pin is not utilized for optimum engagement. The openings 44 and 46 extending completely through the walls 40 and 42 may facilitate the pin members 60 and 62 being fully positioned within the respective openings 46 and 44 for optimum engagement. In certain embodiments, the pin members 60 and 62 may extend about 1 mm, 1.5 mm, or 2 mm to about 3 mm, 4 mm, or 5 mm from each of the respective end portions 54 and 56 of the arms 50 and 52. Since the openings 46 and 44 do not limit the length of the pin members 60 and 62, the pin members 60 and 62 may extend through the openings 44 and 46 and beyond the housing 12. In certain embodiments, the end portions 54 and 56 of the respective arms 50 and 52 may apply an outward force against the respective walls 40 and 42 for increased engagement of the cartridge 11 to the shaving razor shaving razor handle 14.

A user may disengage the shaving razor handle 14 from the shaving cartridge 11 by squeezing the arms 50 and 52 together to decrease $d_2$, resulting in the second position. The pin members 60 and 62 may be closer together in the second position than the first position. For example, in the second position $d_2$ may be less than $d_1$, such that the cartridge 11 may be pulled away from the shaving razor handle 14 with little or no force. Once the cartridge 11 is detached from the shaving razor handle 14, the force applied to the shaving razor handle 14 may be removed, resulting in the pin members 60 and 62 returning to the first position. In the first position the arms 50 and 52 may be fully extended (e.g., the arms 50 and 52 are not flexed because no external force is being applied to the handle).

A user may re-engage the shaving razor handle 14 to the shaving cartridge 11 by squeezing the arms 50 and 52 together, resulting in the second position, which allows the pin members 60 and 62 to be inserted between the walls 42 and 40. The force applied to the arms 50 and 52 may then be released to allow the pin members 60 and 62 to fit into the respective openings 46 and 44. The openings 44 and 46 may extend completely through the walls 40 and 42 to facilitate the visual indication that the shaving cartridge 11 is properly engaged with the shaving razor handle 14. For example, the pin members 60 and 62 and the walls 40 and 42 of the housing 12 may be contrasting colors, to allow a user to quickly determine if the pin members 60 and 62 are properly positioned within the openings 46 and 44.

The shaving razor handle 14 may be molded from polymeric material to facilitate inward displacement (e.g., flexing) of the arms 50 and 52. The shaving razor handle 14 may be a single piece molded construction to improve simplicity and reduce costs (e.g., the 26 body, the neck 28, the pair of opposing arms 50 and 52 and the pin members 60 and 62 are integral). The shaving razor handle 14 may be injection molded from a polymeric material that provides sufficient strength and flexibility to allow the repeated displacement of the arms 50 and 52. The shaving razor handle 14 may be injection molded from a semi-rigid polymeric materials, such as Noryl™ (a blend of polyphenylene oxide (PPO) and polystyrene developed by General Electric Plastics, now SABIC Innovative Plastics). The shaving razor handle 14 may be molded from other semi-rigid polymers having a Shore A hardness of approximately 60 to 140, including, but not limited to acetal, polypropylene, high impact polystyrene (HIPS), acrylonitrile butadiene styrene (e.g., Terluran® GP-22, BASF, The Chemical Company), or any combinations thereof. Other materials or mechanisms may also be used to effectuate the displacement of the arms 50 and 52.

The pin members 60 and 62 may not necessarily return to the same first position after every disengagement of the cartridge 11 from the shaving razor handle 14 because of permanent deformation of the shaving razor handle 14. For example, the pin members 60 and 62 may return to a third position, wherein $d_2$ in the third position may be less with each successive disengagement of the cartridge 11 from the shaving razor handle 14. In certain embodiments, the arms 50 and 52 may have an inner surface 70 that defines the slot 55. In certain embodiments, the inner surface 70 may have a pair of spaced apart opposing protrusions 72 and 74. The pair of protrusions 72 and 74 may act as a pair of stop surfaces to limit deflection of the arms 50 and 52 during engagement and disengagement of the shaving cartridge 11 to the shaving razor handle 14. The protrusions 72 and 74 may prevent premature failure or fatiguing of the arms 50 and 52 by limiting the distance the arms 50 and 52 are displaced. If the displacement of the arms 50 and 52 is not limited, the flexing of the arms 50 and 52 may result in stress levels that are greater than the yield point of the material of the handle 14. If the yield point of the material is exceeded, permanent deformation of the shaving razor handle may result. Permanent deformation may cause the engagement of the cartridge 11 to the shaving razor handle 14 to decrease with each successive deflection of the arms 50 and 52, which may result in the cartridge 11 inadvertently disengaging from the shaving razor handle 14. In certain embodiments, a sufficient flexural strength of the material for the shaving razor handle 14 to minimize permanent deformation may be about 35 MPa, 40 MPa, or 45 MPa to about 65 MPa, 75 MPa, or 85 MPa (ASTM D-790 at 23° C.). Materials with a sufficient flexural strength are given above. In certain embodiments, the protrusions 72 and 74 may be separated by a distance "$d_3$" of about 0.2 mm, 0.4 mm, or 0.6 mm to about 1.5 mm, 2.5 mm, or 3.5 mm to minimize permanent deformation or breaking of the arms 50 and 52.

The tapered slot 55 may allow for a small change in distance between the arms 50 and 52 at the neck 28 to result in a much larger change in distance between the pin members 60 and 62. For example, the arms 50 and 52 may be squeezed together from the first position to the second position such that the protrusions 72 and 74 travel about 1 mm before they contact each other. Even though the protrusions 72 and 74 traveled only about 1 mm before contacting each other, the change in $d_2$ from the first position to the second position may be about 2 mm. In certain embodiments, the change in $d_2$ from the first position to the second position may be about 50%, 75%, or 100% to about 150%, 200%, or 300% greater than the corresponding change in $d_3$.

In certain embodiments, the neck 28 of the shaving razor handle 14 may have an outer surface 75 with one or more finger pads 76 and 78 to indicate the proper location to squeeze the shaving razor handle 14 for engaging and disengaging the shaving cartridge 11 with the shaving razor handle 14. The finger pads 76 and 78 may have a plurality of protrusions 80 and 82 to improve the user's grip when the arms 50 and 52 are squeezed together. The finger pads 76 and 78 may be particularly advantageous when a user must squeeze the arms 50 and 52 together in a wet environment. Other embodiments may include finger pads 76 and 78 with a smooth concave surface. The finger pads 76 and 78 may be molded out of the same material as the shaving razor handle 14 or they may be molded from a softer material to provide a cushion for a more comfortable grip (e.g., finger pads 76 and 78 may be molded from a polymeric material having a Shore A hardness of about 20, 30, or 40 to about 50, 60, or 70).

Figure 5:
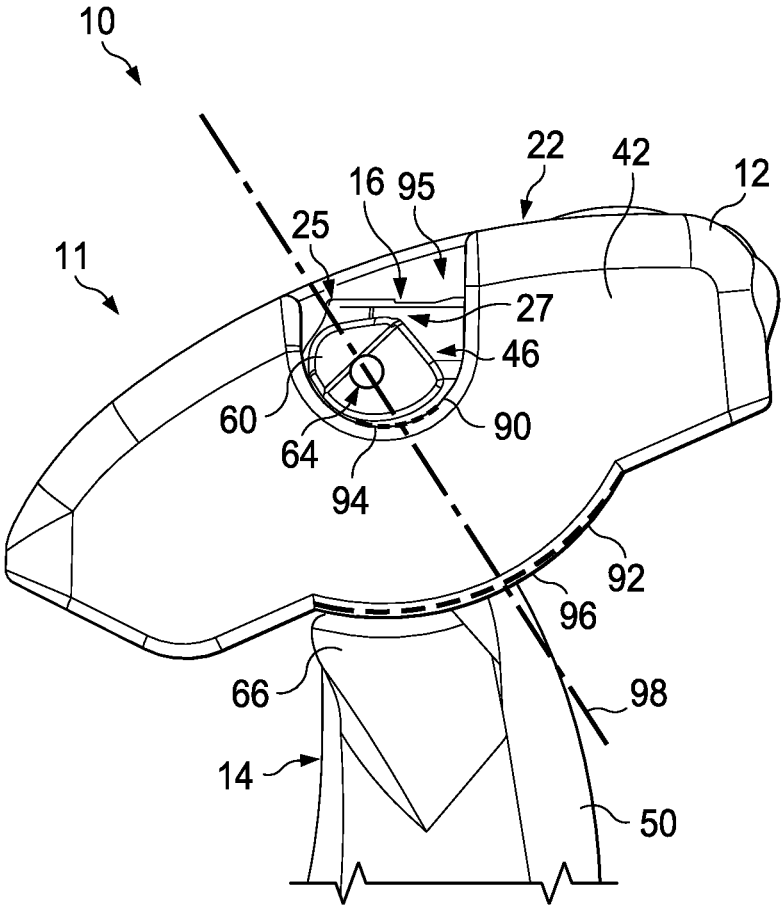
FIG. 5 is a partial right side view of the shaving razor of FIG. 1.

Referring to FIG. 5, a partial right side view of the shaving razor 10 is illustrated with the arm 50 of the shaving razor handle 14 engaged with the wall 42 of the housing. For purposes of clarity and brevity, only the wall 42 of the housing 12 and the arm 50 of the shaving razor handle 14 will be described in full detail, as it is understood that the right side view of the shaving razor 10 is a mirror image of the left side view of the shaving razor 10. The features of the wall 42 of the housing 12 and arm 50 of the shaving razor handle 14 may be referred to as complementary features of the wall 40 of the housing 12 and arm 52 of the shaving razor handle 14. The pin member 60 may be positioned within the opening 46 of the wall 42. In certain embodiments, the pin member 60 may have a diameter of about 1.5 mm, 2.0 mm, or 3.0 mm to about 3.5 mm, 4.0 mm or 4.5 mm. The diameter of the pin member 60 may be smaller than the opening 46 to provide a rinse gap 27 between the blade 16 and the pin member 60 for allowing water to access the blade 16. In certain embodiments, the rinse gap 27 may be about 0.10 mm, 0.125 mm, or 0.15 mm to about 0.3 mm, 0.4 mm, or 0.5 mm. The wall 42 may have a pair of opposing bearing surfaces 90 and 92 that define a pair of concentric arcs 94 and 96 (represented by dotted lines). The bearing surface 90 may define a "U" shaped slot 95 that is in communication with the opening 46 to facilitate the removal of shaving debris from the blade 16 during rinsing. As shown in FIG. 5, the blade 16 may be accessed by water from the sides of the housing 12 for improved rinsing.

A plane 98 may intersect the axis of rotation 64 and extend through the center of the concentric arcs 94 and 96. The plane 98 may also extend through the center of the top surface 22 of the housing 12 to facilitate the balancing of the shaving cartridge 11. The plane 98 may be within about 0%, 2%, or 4% to about 6%, 8%, or 10% from the center of the top surface 22 of the housing 12. For example, if the plane 98 is within 0% of the middle of the top surface 22 of the housing, the plane 98 bisects the top surface 22 in half, resulting in the shaving cartridge 11 being balanced about the axis of rotation 64. The arcuate top surface 22 of the housing 12 and the balancing of the housing 12 allows the shaving cartridge 11 to rotate to the proper position against the surface of the skin with the application of little or no force to provide a more comfortable shave. In certain embodiments, an edge 25 of the blade 16 may also be positioned on the plane 98.

The wall 42 of the housing 12 may be slidingly engaged between the pin member 60 and the support member 66 to reduce ancillary movements of the shaving cartridge 11. The pin member 60 and the support member 66 may limit movement of shaving cartridge 11 to rotation about the axis of rotation 64 to provide for smooth rotational movement of the shaving cartridge 11 relative to the shaving razor handle 14. The bearing surface 90 may slidingly engage the pin member 60 and the bearing surface 92 may slidingly engage the support member 66. The support member 66 may contact the bearing surface 92 to prevent the pin member 60 from traveling axially and contacting the blade 16, which may damage the blade 16. The pin member 60 is not limited to completely circular or symmetrical cross sections, for example, the cross section of the pin member 60 may be truncated resulting in a semi-circular cross sectional shape. Various semi-circular shapes may be utilized for the pin member 60 to allow the size of the rinse gap 27 to be increased for improving cleaning of the blades 16. A semi-circular cross sectional shape may facilitate proper sliding of the pin member 60 against the bearing surface 94 during the desired amount of rotation of the shaving cartridge 11. In certain embodiments, the shaving cartridge 11 may move about the rotation axis a total of about 10 degrees, 15 degrees, or 20 degrees to about 30 degrees, 40 degrees or 50 degrees. A semi-circular cross sectional shape may facilitate the positioning of the pin member 60 closer to the blade 16 (without contacting the blade 16), which results in the axis of rotation 64 being positioned closer to the blade 16 for improved control of the shaving cartridge 11 during shaving.

Figure 6:
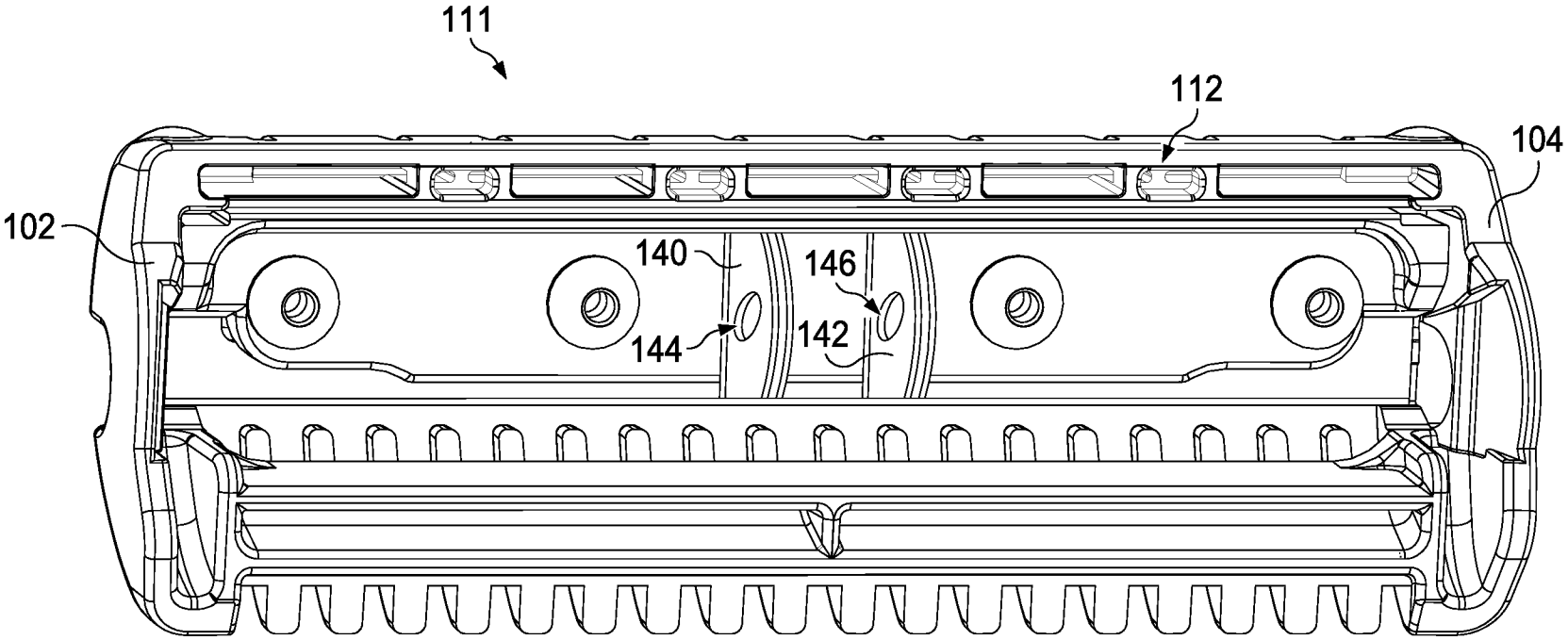
FIG. 6 is a bottom view of another possible embodiment of a shaving cartridge which may be incorporated into the shaving razor of FIG. 1.

Referring to FIG. 6, a bottom view of an alternative embodiment of a shaving cartridge 111 having a housing 112 is shown. The shaving cartridge 111 and the housing 112 may be substantially the same as the shaving cartridge 11 and the housing 12 previously described, however, the housing 112 may have a pair of spaced apart interior walls 140 and 142 that define a pair of fully enclosed openings 144 and 146 that extend completely through the spaced apart walls 140 and 142. The openings 144 and 146 may be dimensioned to receive pin members, such as pin members 60 and 62 described above. The pair of spaced apart walls 140 and 142 may be positioned between a pair of end walls 102 and 104 of the housing 112. Each of the walls 140 and 142 may be disposed between one of the pin members 60 and 62 and one of the support members 66 and 68 for proper engagement and rotation of the shaving cartridge 111 relative to a handle, such as the shaving razor handle 14 (as previously described).

Figure 7A:
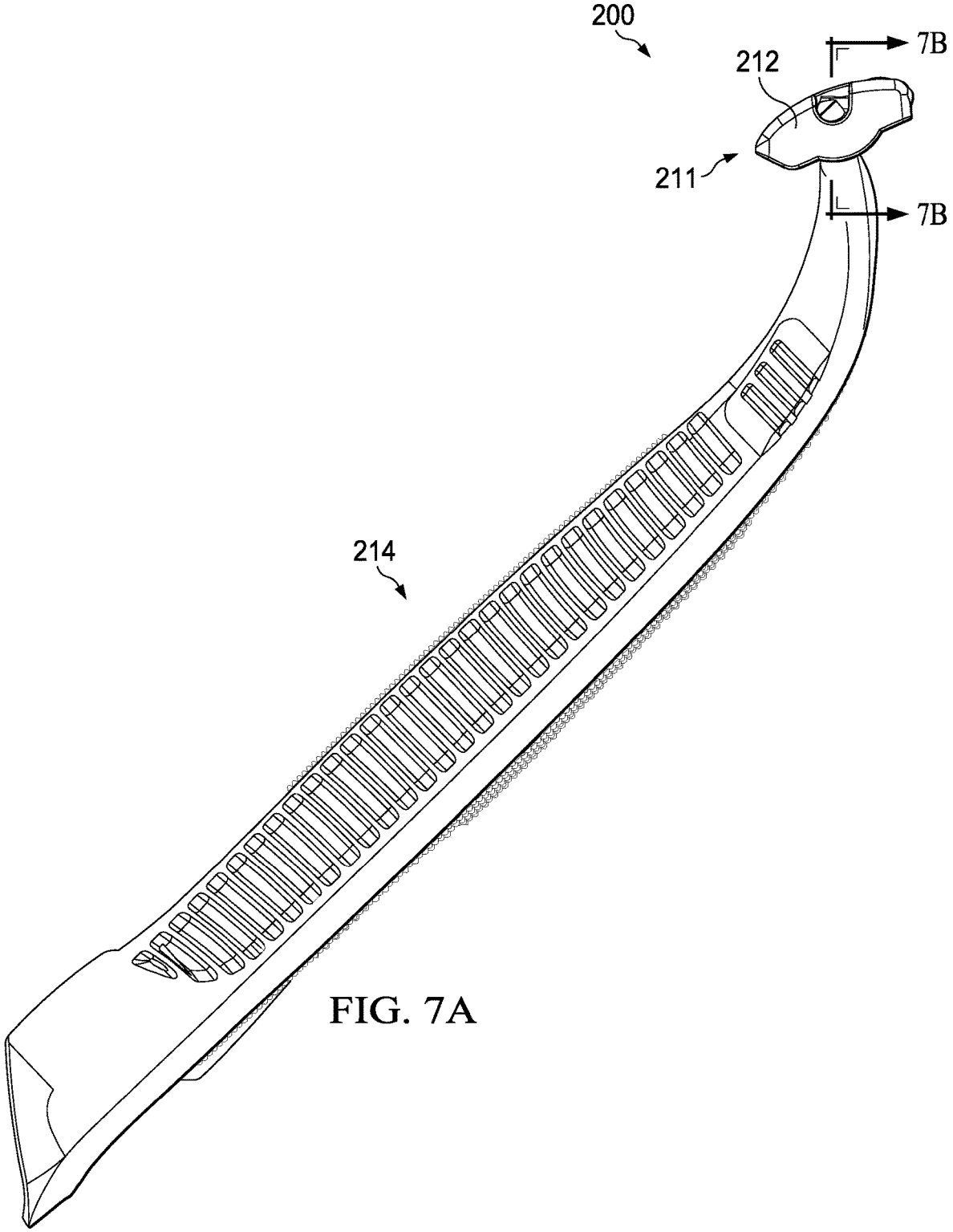
FIG. 7A is a right side view of another possible embodiment of a shaving razor.
Figure 7B:
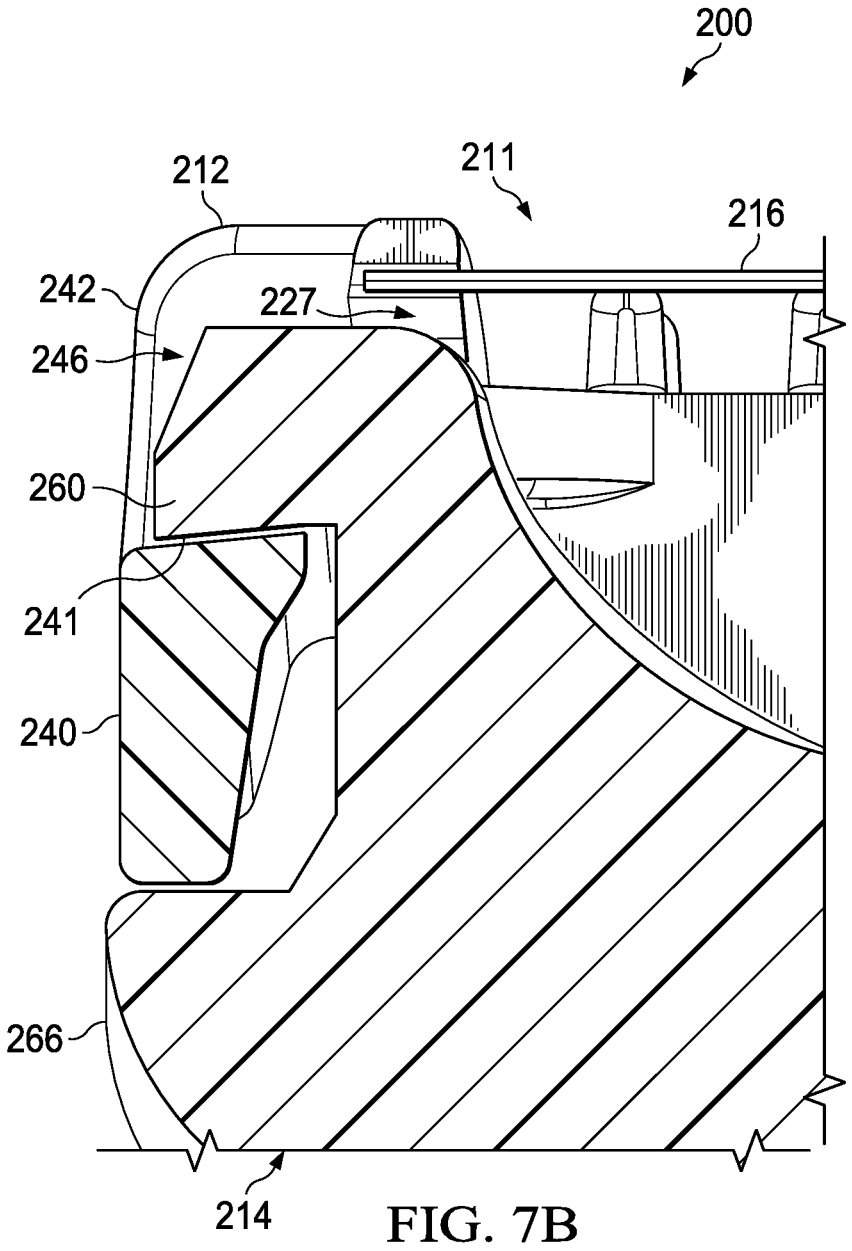
FIG. 7B is a partial bottom cross section view from the right side of the shaving razor, taken generally on the line 7-7.

Referring to FIGS. 7A and 7B, another possible embodiment of a shaving razor 200 is shown. FIG. 7A shows a right side view of the shaving razor 200 having a shaving cartridge 211 with a housing 212 engaged to a handle 214. FIG. 7B is a partial bottom cross section view of the shaving razor 200 taken generally along the line 7B-7B of FIG. 7A. The shaving razor handle 214 may be similar to the shaving razor handle 14 as previously described, for example, the housing 212 may have a wall 242 defining a fully enclosed opening 246 extending therethrough and the shaving razor handle 214 may have a pin member 260 and a support member 266 that engage the housing 212. For purposes of clarity and brevity, only one side of the shaving razor 200 is shown. The housing 212, the support member 266, and the pin member 260 will be described in detail, as it is understood that the right side view of the shaving razor 200 is a mirror image of the left side view of the shaving razor 200. The shaving razor 200 may be substantially the same as the shaving razor 10 as previously shown and described, however, the pin member 260 may taper outwardly toward the support member 266. The tapered pin member 260 may provide for improved engagement with the housing 212. The housing 212 may have a wall 240 with a corresponding tapered surface 241 to further improve engagement of the shaving razor handle 214 to the housing 212. The tapered pin member 260 and the opening 246 may still provide for a rinse gap 227 between the pin member 260 and a blade 216.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor cartridge comprising:

a housing having a pair of opposing walls disposed at opposite sides of the housing, each wall defining an opening extending there through, each of the walls having a pair of opposing bearing surfaces that define a pair of respective concentric arcs, at least one of the bearing surfaces of each wall defines a "U"-shaped slot that is in communication with the respective opening; and at least one blade mounted to the housing, the blade having an edge wherein water can access the edge from a top and bottom of the housing and from the sides of the housing through the openings in the walls.

2. The shaving cartridge of claim 1 wherein a plane extends through a center of the concentric arcs and the edge of the blade is positioned on the plane.

3. A shaving razor comprising:

a razor handle having a body providing an area for a consumer to grip the handle and a neck extending from the body, the neck having a pair of opposing arms that taper outwardly and define a tapered slot that extends into the neck wherein the arms taper closer together toward a base of the tapered slot where the arms meet, wherein each arm has an end portion with a pin member having a cross section and extends outwardly from each of the respective end portions and each of the pin members are parallel to and spaced apart from a respective support member on each of the arms; and a housing mounted to the handle, the housing having a pair of opposing walls each defining an opening extending there through, each of the walls having a pair of opposing bearing surfaces that define a pair of respective concentric arcs, at least one of the bearing surfaces of each wall defines a "U"-shaped slot that is in communication with the respective opening, wherein each pin member is disposed in a respective opening to mount the housing to the handle, and wherein the cross section of each pin member is truncated with respect to a corresponding cross section of the respective opening in the corresponding wall of the housing.

4. The shaving razor of claim 3 wherein the pin members extend through the openings and beyond the housing.

* * * * *